US006944310B2

(12) United States Patent
Ito et al.

(10) Patent No.: US 6,944,310 B2
(45) Date of Patent: Sep. 13, 2005

(54) SPEAKER APPARATUS

(75) Inventors: Masanori Ito, Yamagata (JP); Kunio Mitobe, Yamagata (JP); Osamu Takahashi, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 0 days.

(21) Appl. No.: 10/377,782

(22) Filed: Mar. 4, 2003

(65) Prior Publication Data

US 2003/0164262 A1 Sep. 4, 2003

(30) Foreign Application Priority Data

Mar. 4, 2002 (JP) ..... P2002-057638

(51) Int. Cl.[7] ..... H04R 1/02; H04R 7/00

(52) U.S. Cl. ..... 381/386; 181/171; 340/391.1

(58) Field of Search ..... 381/386, 394, 381/189, 396, 409; 181/157, 171, 172, 173; 340/391.1, 384.1

(56) References Cited

U.S. PATENT DOCUMENTS

| | | | | | |
|---|---|---|---|---|---|
| 3,935,400 | A | * | 1/1976 | Koga | 381/430 |
| 4,315,112 | A | * | 2/1982 | Hofer | 381/186 |
| 5,515,432 | A | * | 5/1996 | Rasmusson | 379/388.01 |
| 5,664,024 | A | * | 9/1997 | Furuta et al. | 381/412 |
| 6,208,238 | B1 | * | 3/2001 | Ohta | 381/396 |
| 6,400,825 | B1 | * | 6/2002 | Miyamoto et al. | 381/409 |
| 6,654,476 | B1 | * | 11/2003 | Guenther | 381/407 |
| 2003/0121718 | A1 | * | 7/2003 | Stead et al. | 181/172 |

FOREIGN PATENT DOCUMENTS

| | | | | |
|---|---|---|---|---|
| GB | 2345402 A | * | 7/2000 | H04R/9/06 |
| JP | 04351199 A | * | 12/1992 | H04R/9/04 |
| JP | 5-344590 | | 12/1993 | |
| JP | 05344590 A | * | 12/1993 | H04R/9/04 |
| JP | 9-322289 | | 12/1997 | |
| JP | 11-146487 | | 5/1999 | |
| JP | 2000-333294 | | 11/2000 | |

* cited by examiner

*Primary Examiner*—Marlon T. Fletcher
*Assistant Examiner*—Eduardo Colon Santana
(74) *Attorney, Agent, or Firm*—Sughrue Mion, PLLC

(57) ABSTRACT

A speaker apparatus includes an elliptical-shaped or a round-edged rectangular-shaped vibration plate; an edge damper portion disposed on an outer peripheral edge portion of the vibration plate; a recessed portion formed between said vibration plate and said edge damper portion, having a caliber of a shape corresponding to the shape of said vibration plate; and an air core voice coil fitted into an interior of said recessed portion. The speaker apparatus further includes a frame for mounting said edge damper portion to support said vibration plate, having a stepped portion and a vertical wall portion; and an edge damper frame arranged on an outer periphery of said edge damper portion, having a support portion placed on the stepped portion and a rising portion being in contact with the vertical wall portion.

6 Claims, 4 Drawing Sheets

SPEAKER APPARATUS

The present disclosure relates to the subject matter contained in Japanese Patent Application No. 2002-057638 filed on Mar. 4, 2002, which is incorporated herein by reference in its entirety.

BACKGROUND OF THE INVENTION

1. Field of the Invention

The present invention relates to a speaker apparatus and, in particular, to a speaker apparatus which is used in a microspeaker (a small-sized or subminiature speaker) and has a dome-type vibration plate having an elliptical shape or a round-edged rectangular shape.

2. Description of the Related Art

Conventionally, a speaker apparatus, which is used as a voice output apparatus of an acoustic system such as an audio system, converts an electric signal including an audio component output from an amplifier into air vibrations to thereby reproduce and output voice data and acoustic data.

A speaker, which is classified as a dynamic-type speaker according to the operation principle, can be roughly divided into a cone-type speaker the voice coil of which is driven in the root portion (cone neck portion) of a conical-shaped vibration plate, and a dome-type speaker the voice coil of which is driven in the outer peripheral portion of a vibration plate.

The cone-type speaker is generally used as a low tone speaker having a large caliber. On the other hand, in the case of the dome-type speaker, because it is driven by a voice coil having substantially the same caliber as the vibration plate, it is used as a middle and high tone speaker having a small-caliber as vibration plate; and also, recently, the dome-type speaker is used as a microspeaker (a small-sized or subminiature speaker) which is built in a cell phone.

As a specific example of the dome-type speaker, there are known "dome speaker and a method for manufacturing the same" which is disclosed in JP-A-11-146487. According to this, there are shown a dome-type speaker in which a semi-spherically-shaped vibration plate is formed flat, and a method for assembling the neighboring portion of a voice coil in which there is formed a U-shaped groove between a dome portion composed of a vibration plate having a dome shape and an edge damper portion existing in the outer periphery of the dome portion, the voice coil is inserted into the interior of the present groove and is fixed there using an adhesive agent.

And, there are also known "speaker unit and a method for manufacturing the same" which is disclosed in JP-A-9-322289. According to this, there is shown a technique in which, in a dome-type speaker having a semispherical-shaped vibration plate main portion, a rising portion is formed in the end edge of the support portion of the vibration plate and, when placing the support portion on the stepped portion of a speaker frame, the rising portion is fitted with a vertical wall portion formed so as to be continuous with the stepped portion while sliding the rising portion in contacted with the vertical wall portion.

As a microspeaker (a small-sized or subminiature speaker) to be built in a cell phone, there is often used the above-mentioned dome-type speaker; however, in order to expand a frequency range and enhance voice quality, in a narrow speaker installation area, there must be installed a speaker having a caliber which is as large as possible.

Therefore, as a method for installing a speaker having a caliber as large as possible in a limited space, there can be expected a method in which a vibration plate is formed in an elliptical shape or in a round-edged rectangular shape.

As an example in which a vibration plate is formed in an elliptical shape or in a round-edged rectangular shape, there is known a cone-type speaker designed for carriage on a car (for example, "an elliptical-shaped speaker" which is disclosed in JP-A-2000-333294).

In the case of the cone-type speaker with an elliptical-shaped vibration plate or a round-edged rectangular-shaped vibration plate as disclosed in the above-cited publication, since the vibration plate is situated outside a voice coil, the voice coil (and voice coil bobbin) may be circular in shape.

However, in the case of the dome-type speaker, when a vibration plate is formed elliptical or round-edged rectangular in shape, a voice coil must be formed elliptical or round-edged rectangular in shape.

Referring again to the speaker apparatus shown in "a dome speaker and a method for manufacturing the same" disclosed in the above-cited publication JP-A-11-146487, there is suggested a structure in which a substantially spherical shaped vibration plate is formed flat; and, even in case where the substantially spherical shaped vibration plate is formed flat, since the periphery of the vibration plate is circular in shape, there is employed a dome-type structure having a circular-shaped caliber, in which there is used a cylindrical-shaped voice coil.

On the other hand, a method for manufacturing an elliptical-shaped voice coil with a voice coil wound on a voice coil bobbin is disclosed in JP-A-5-344590.

However, the manufacturing method disclosed in the above-cited publication requires a specific jig tool when assembling the voice coil. And, in the case of an air core voice coil excluding a voice coil bobbin, when manufacturing the air core voice coil, it causes a spring back phenomenon, which raises a problem that the voice coil is easy to deform in shape.

Also, in the case of the elliptical-shaped or round-edged rectangular-shaped speaker apparatus, not only the center positions of the vibration plate, voice coil and magnetic gap must be made to coincide with each other, but also the directions of these components must be made to coincide with each other in order to prevent their axial-direction rotational movements from shifting from each other.

Further, as disclosed in the above-cited publication JP-A-9-322289, in the structure in which the rising portion is formed in the end edge of the support portion of the vibration plate to thereby position the frame and vibration plate, a stepped portion is formed on the entire periphery of the frame and the stepped-portion-formed portion of the frame increases in thickness by an amount corresponding to such provision of the stepped portion, which increases the weight of the frame.

SUMMARY OF THE INVENTION

The invention aims at eliminating the drawbacks found in the above-mentioned conventional speaker apparatus. Accordingly, it is therefore an object of the invention to provide a speaker apparatus including an elliptical-shaped or a round-edged rectangular-shaped dome-type vibration plate for use in a microspeaker (a small-sized or subminiature speaker), which can prevent deformation of an air core voice coil, can facilitate adjustment of the center position and direction of the air core voice coil, and can reduce the weight of a frame.

In order to achieve the above object, according to the invention, there is provided a speaker apparatus including: a vibration plate having an elliptical shape or a round-edged rectangular shape; an edge damper portion disposed on the outer peripheral edge portion of said vibration plate; an air core voice coil having an elliptical shape or a round-edged rectangular shape; and a recessed portion formed between said vibration plate and said edge damper portion, and contains said air core voice coil in such a manner that the major-axis and minor-axis directions of said air core voice coil corresponds to the major-axis and minor-axis directions of said vibration plate.

In this configuration, since the air core voice coil is fitted into an interior of the recessed portion, the air core voice coil being formed to have such an elliptical shape or a round-edged rectangular shape corresponding to the vibration plate, there can be realized a dome-type speaker including an elliptical-shaped or a round-edged rectangular-shaped vibration plate. And, because the air core voice coil is fitted into the recessed portion of the vibration plate, not only the deformation of the air core voice coil can be prevented but also the center position and direction of the air core voice coil can be corrected to its normal position and direction easily without using a special jig.

Also, a speaker apparatus according to the invention may further include a frame for mounting said edge damper portion to support said vibration plate, having a stepped portion and a vertical wall portion; and an edge damper frame arranged on an outer periphery of said edge damper portion, having a support portion placed on the stepped portion and a rising portion being in contact with the vertical wall portion.

In this configuration, since the outer peripheral edge portion of the frame and the outer peripheral edge portion (edge damper frame) of the vibration plate are guided in such a manner that the center position of the vibration plate can be prevented from shifting, the center positions and directions of the magnetic gap, air core voice coil and vibration plate can be matched to each other more easily.

Also, in a speaker apparatus according to the invention, the rising portion is formed along an entire periphery of said edge damper frame.

In this configuration, the center positions and directions of the magnetic gap, air core voice coil and vibration plate can be matched to each other more accurately.

And, in a speaker apparatus according to the invention, the rising portion is formed on such peripheral portion of said edge damper frame that opposes mutually to the major-axis direction of said edge damper frame and has a large curvature. Also, the rising portion is formed on the curved portion of the round-edged rectangular shape of said edge damper frame.

In configurations herewith, it is possible to reduce the thickness of such portion of the frame that is opposed to the portion of the edge damper portion where the rising portion is not disposed. This not only can match together the center positions and directions of the magnetic gap, air core voice coil and vibration plate accurately but also can reduce the weight of the frame.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Referring now to the accompanying drawings, there are shown preferred embodiments of the invention.

Figure 1:
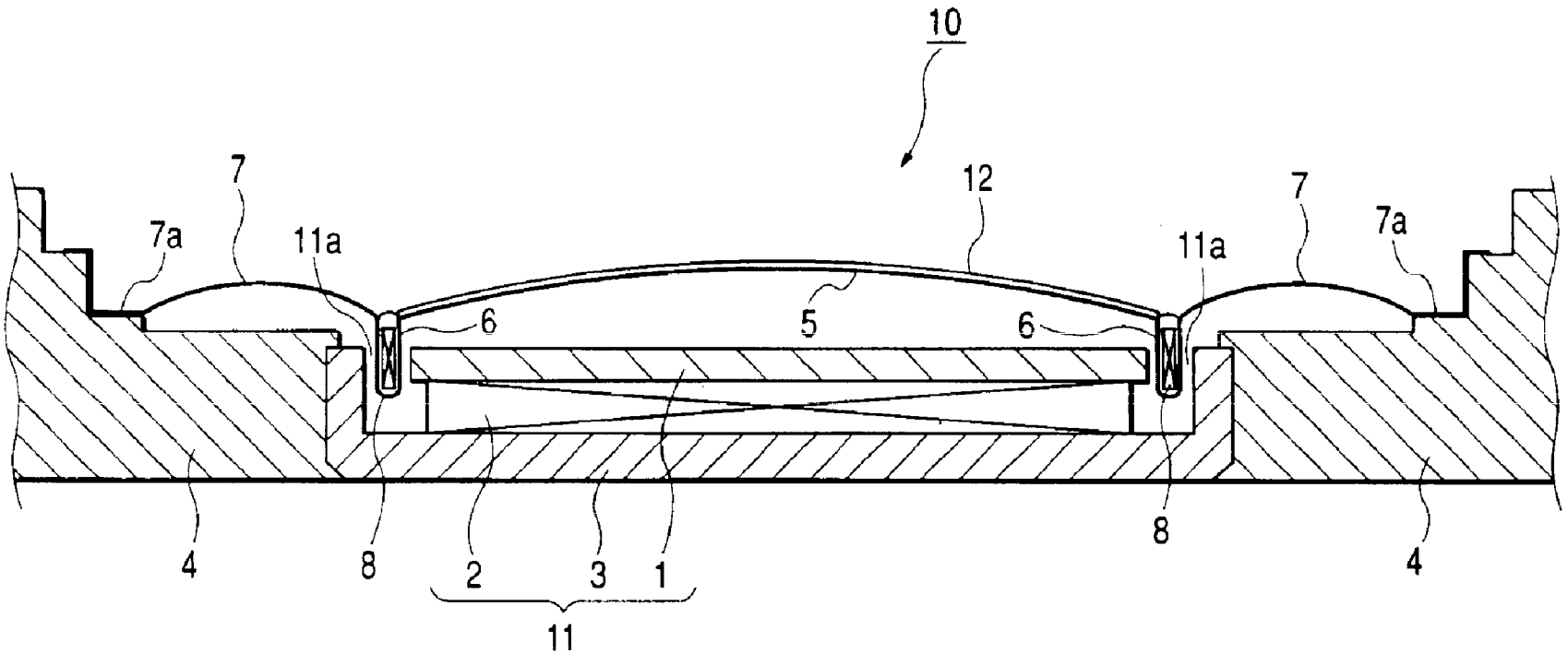
FIG. 1 is a section view of the structure of the main portions of a speaker apparatus according to a first embodiment of the invention.

Now, description will be given below of the preferred embodiments of a speaker apparatus according to the invention with reference to the accompanying drawings. FIG. 1 shows a section view of the structure of the main portions of a speaker apparatus according to a first embodiment of the invention, and FIG. 2 is a section view of the detailed structure of the voice coil peripheral portion of FIG. 1.

[First Embodiment]

Figure 2:
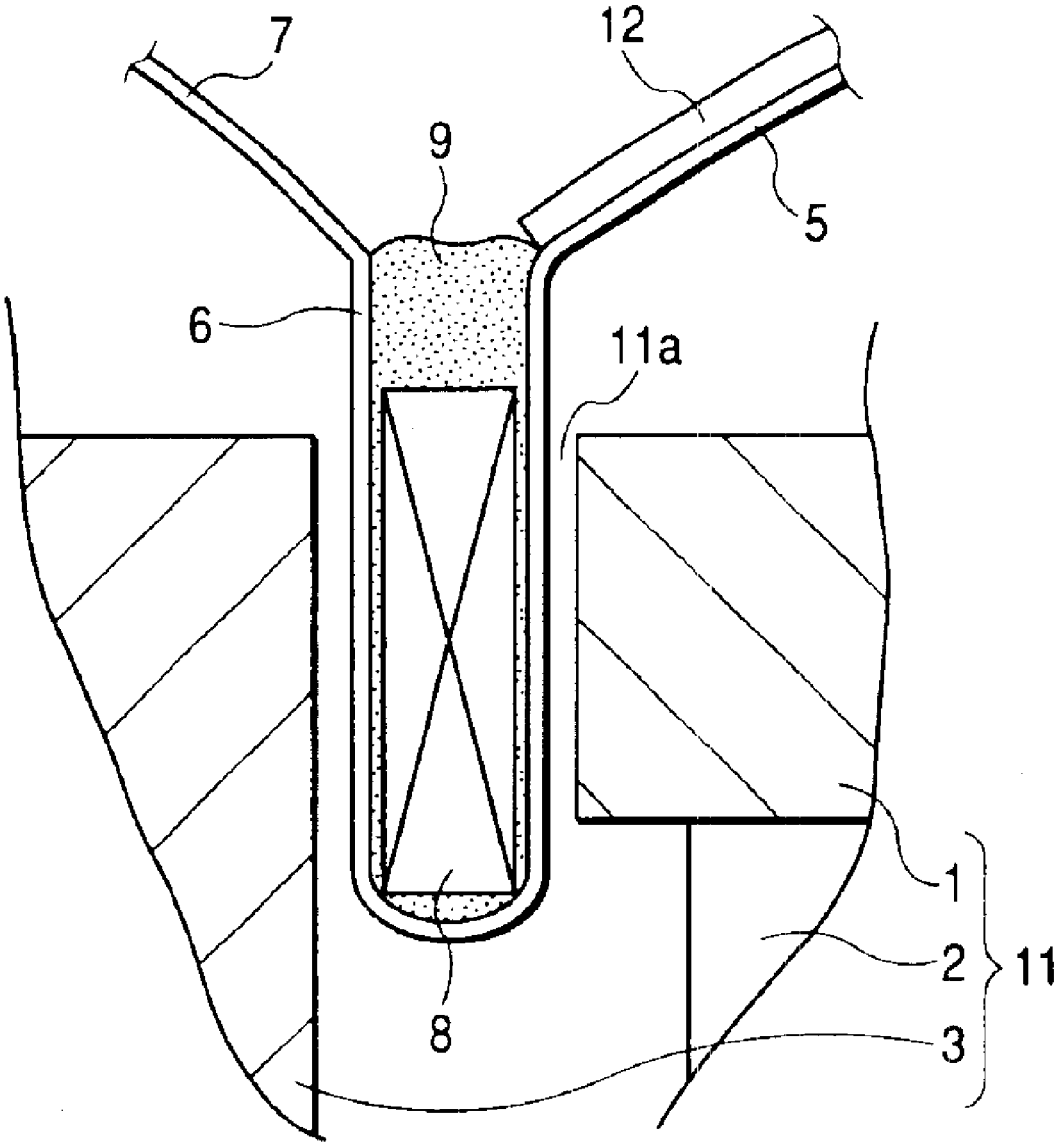
FIG. 2 is an enlarged section view of a speaker apparatus according to the first embodiment, showing a structure for fitting an air core voice coil used in the speaker apparatus.

As shown in FIGS. 1 and 2, a speaker apparatus 10 according to the first embodiment of the invention comprises a pole plate 1 having an elliptical-shaped caliber, a magnet 2 and a yoke 3 respectively used to make a magnetic circuit 11 including an elliptical-ring-shaped magnetic gap 11*a*, a frame 4 serving as a lower support structure, a dome-type vibration plate 5 formed in a shape obtained by turning an egg shape into a flat shape and having an elliptical-shaped section, an elliptical-ring-shaped recessed portion 6 formed in the outer peripheral edge portion of the vibration plate 5 and having a U-shaped section, an edge damper portion 7 formed in the outer peripheral edge portion of the recessed portion 6, an air core voice coil 8 fitted into the recessed portion 6 and fixed thereto with an adhesive agent 9 and having an elliptical-shaped caliber, and a cap 12 bonded to the vibration plate 5.

Instead of the above-mentioned elliptical shape, there may also be employed a long and narrow shape in which the major-axis-direction portion thereof is formed in a straight line and the minor-axis-direction portion thereof is formed in a curved shape (an arc), which will be hereinafter referred to as a round-edged rectangular shape.

Also, on the outer peripheral edge portion of the edge damper portion 7, there is disposed an edge damper frame 7*a*. The frame 4 can be formed of resin. Further, the vibration plate 5, recessed portion 6, edge damper portion 7, and edge damper frame 7*a* can be formed as an integral structure by heating and pressurizing a sheet of resin film.

The air core voice coil 8 can be formed by winding an electric wire in such a manner as to have an elliptical-shaped caliber, and the thus formed air core voice coil is then fitted into the recessed portion 6. Therefore, the caliber (major axis, minor axis) of the present elliptical shape are substantially coincident with the caliber (major axis, minor axis) of an ellipse drawn by the center of the recessed portion 6 formed in the outer peripheral edge portion of the vibration plate 5 and having an elliptical-shaped caliber.

Although not shown, positive and negative input terminals are respectively connected electrically to the two ends of the air core voice coil 8 through their associated lead wires (tinsel cord wires).

The cap 12 can be made of material higher in both specific gravity and Young's modulus than material of which the vibration plate 5 is made. For example, aluminum and titanium can be used.

Now, description will be given below of the functions of the main portions of the speaker apparatus 10 according to the present embodiment. The pole plate 1, magnet 2 and yoke 3 cooperate together in forming a magnetic circuit including an elliptical-ring-shaped magnetic gap. The frame 4, which is situated in the outer peripheral edge portion of the yoke 3, serves as the lower structure of the speaker apparatus to support the whole of the speaker apparatus 10.

The vibration plate 5 includes the recessed portion 6 in the outer peripheral edge portion thereof; and, the recessed portion 6 is inserted into the (elliptical-ring-shaped) magnetic gap 11*a* formed by the magnet 2 and yoke 3 in such a manner that the center thereof is matched to the center of the magnetic gap 11*a*, and the recessed portion 6 is floatingly supported.

Also, the recessed portion 6 is fitted with the air core voice coil 8 in the outer peripheral edge portion of the vibration plate 5; and, the air core voice coil 8 is vibrated in accordance with a voice signal within the magnetic gap 11*a* and further transmits its vibrations to the vibration plate 5.

The edge damper portion 7 supports the vibration plate 5 and recessed portion 6 elastically. Also, the edge damper frame 7*a*, which is disposed in such a manner that it includes a horizontal surface in the outer peripheral edge portion of the edge damper portion 7, is mounted in such a manner that its support portion 13 is supported on a stepped portion 16 formed in the frame 4.

According to the above structure, the edge damper portion 7 not only can position the center of the recessed portion 6 accurately at the center position of the (elliptical-ring-shaped) magnetic gap 11*a* existing in the magnetic circuit 11 formed by the pole plate 1, magnet 2 and yoke 3, but also can support it there floatingly.

The cap 12 is bonded on the vibration plate 5 over the entire surface of the vibration plate 5 using an adhesive agent so as to prevent the vibration plate 5 against distortion, while the cap 12 decides the acoustic characteristic (frequency range characteristic) of the vibration plate 5.

Figure 3A:
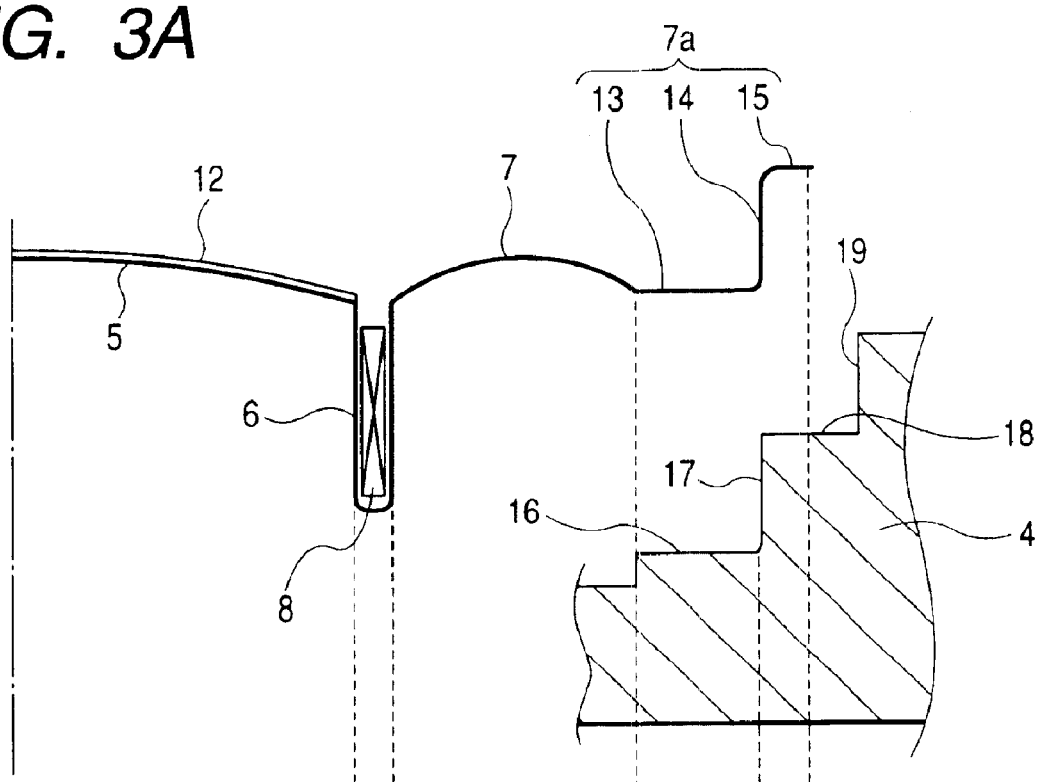
FIG. 3A is a section view to show an assembling method of a speaker apparatus according to the first embodiment.
Figure 3B:
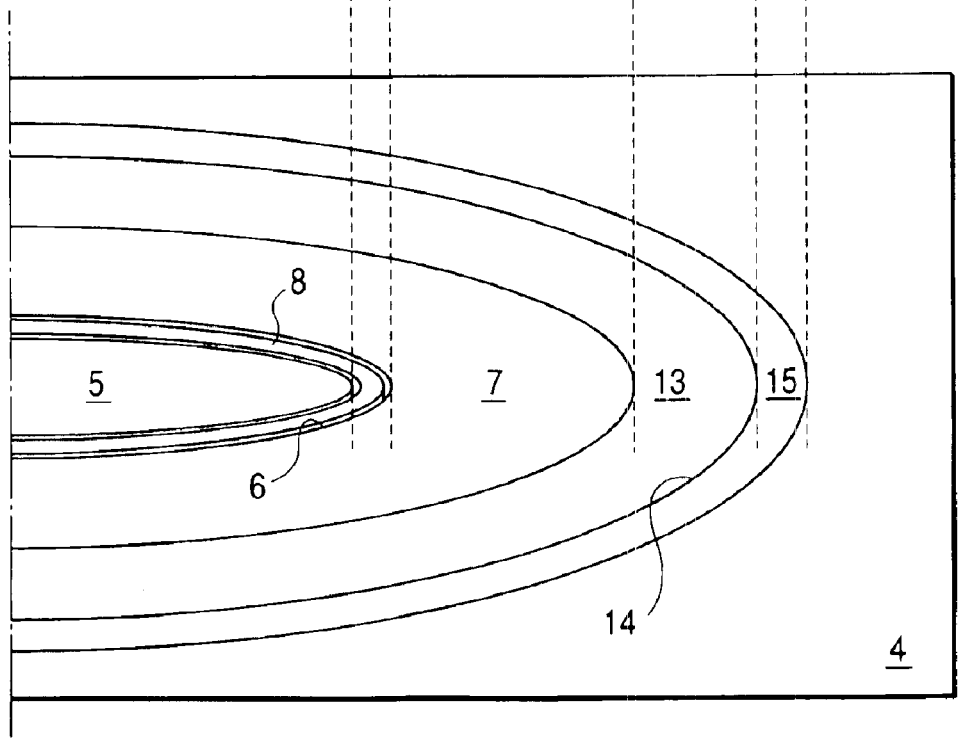
FIG. 3B is a plan view to show an assembling method of a speaker apparatus according to the first embodiment.

Next, description will be given below of a method for mounting together the frame 4 and edge damper portion 7 of the speaker apparatus 10 according to the present embodiment with reference to FIG. 3. Specifically, FIG. 3A is a detailed section view of a right half section of the speaker apparatus, while FIG. 3B is a plan view of the right half section of the speaker apparatus, corresponding to FIG. 3A.

The detailed section structure of the right half section of the speaker apparatus 10 is shown in FIG. 3, in which frame 4 comprises a stepped portion 16, a second stepped portion 18, a vertical wall portion 17 for connecting together the stepped portion 16 and second stepped portion 18 continuously, and an upper-most vertical wall portion 19. Also, the edge damper frame 7*a* includes a support portion 13, a rising portion 14 and a securing portion 15.

In a manufacturing process for mounting together the frame 4 and edge damper portion 7, firstly, the support portion 13 of the edge damper frame 7*a* is placed on the stepped portion 16 of the frame 4 and, at the then time, the rising portion 14 is positioned by the vertical wall portion 17 to thereby be able to prevent the center of the vibration-plate 5 from shifting in the right direction.

Also, in the left half section (not shown) of the speaker apparatus 10, the center of the vibration plate 5 can be prevented from shifting in the left direction as well. Similarly, since the vibration plate 5 is guided in such a manner that the position shift of the center of the vibration plate 5 can be prevented over the entire periphery of the vibration plate 5 having an elliptical-shaped caliber, the vibration plate 5 can be installed in such a manner that the center of the vibration plate 5 is coincident with the center of the pole plate 1.

As a result of this, the vibration plate 5 can be positioned in such a manner that the center of the recessed portion 6 formed in the outer peripheral edge portion of the vibration plate 5 is accurately coincident with the center position of the (elliptical-ring-shaped) magnetic gap 11*a* exiting in the magnetic circuit 11 formed by the pole plate 1, magnet 2 and yoke 3.

Also, the recessed portion 6 formed in the outer peripheral edge portion of the vibration plate 5 is previously formed in the same elliptical shape as the air core voice coil 8. Therefore, even in case where the air core voice coil 8 itself to be inserted into the recessed portion 6 is slightly deformed when it is manufactured, by inserting and fixing the air core voice coil 8 to the interior of the recessed portion 6, the shape of the air core voice coil 8 can be corrected to a normal elliptical shape (the elliptical shape of the recessed portion 6).

[Second Embodiment]

Figure 4:
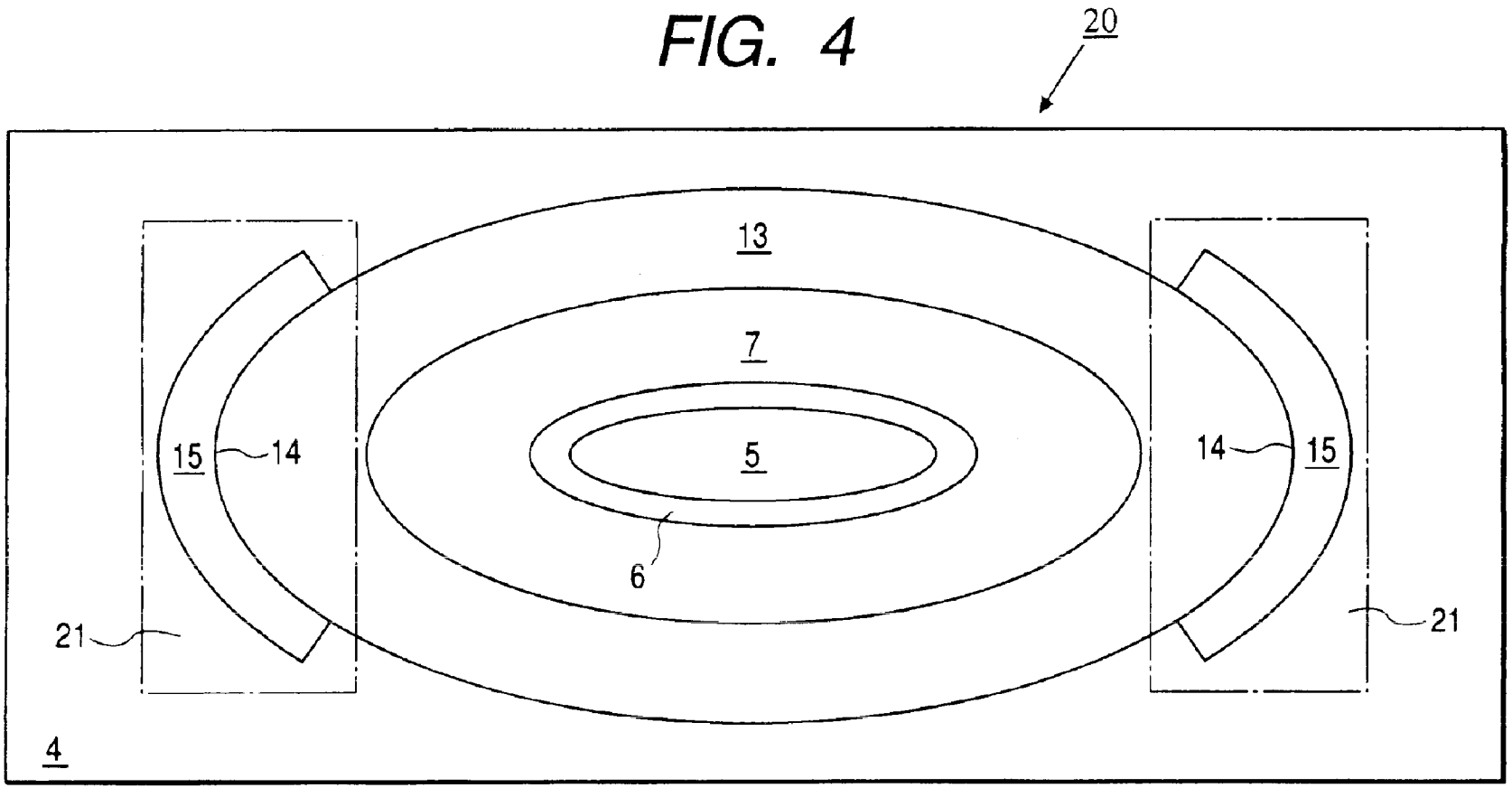
FIG. 4 is a plan view of the structure of a speaker apparatus according to a second embodiment of the invention.

Now, FIG. 4 is a plan view of a speaker apparatus according to a second embodiment of the invention, showing the characteristics of the present speaker apparatus.

In the speaker apparatus 10 shown in FIG. 3, the rising portion 14 and its securing portion 15 are disposed over the entire periphery of the edge damper frame 7*a*; whereas, in the speaker apparatus 20 according to the second embodiment, as shown in FIG. 4, the rising portion 14 and its securing portion 15 are disposed only in a peripheral portion 21 which is opposed to the major-axis direction of the edge damper frame 7*a* and has a large curvature.

Also, in case where, instead of the above-mentioned elliptical shape, there is employed a long and narrow shape (a round-edged rectangular shape) in which the major-axis-direction portion thereof is formed in a straight line and the minor-axis-direction portion thereof is formed in a curved-shaped portion (an arc), the rising portion 14 and its securing portion 15 are disposed only in the curved-shaped portion.

Due to the above structure, there is eliminated the need for provision of the vertical wall portion 17, second stepped portion 18 and upper-most vertical wall portion 19 of the frame 4 that correspond to the portions where the rising portion 14 and its securing portion 15 of the edge damper frame 7*a* are not disposed.

The other remaining structures of the second embodiment than the above-mentioned structures thereof are similar to those of the speaker apparatus according to the first embodiment and, therefore, the description thereof is omitted here.

In the present embodiment, the rising portion 14 and its securing portion 15 are disposed only in the peripheral portion 21 opposed to the major-axis direction of the edge damper frame 7*a* and having a large curvature, not in the remaining portions of the edge damper frame 7*a*.

Accordingly, since the portions where the rising portion 14 and its securing portion 15 of the edge damper frame 7*a* are not disposed are structured such that the vertical wall portion 17, second stepped portion 18 and upper-most vertical wall portion 19 of the frame 4 are not formed, there can be reduced the thicknesses of the portions of the frame 4 that are opposed to the above portions, which makes it possible to reduce the weight of the speaker apparatus 20.

The present invention is not limited to the above-mentioned first and second embodiments, but various changes and modifications are possible without departing from the subject matter of the invention. Also, the securing portion 15 is not always necessary but can be omitted.

As has been described heretofore in detail, according to the invention, there can be realized a dome-type speaker with an elliptical-shaped or a round-edged rectangular-shaped vibration plate, including: an elliptical-shaped or a round-edged rectangular-shaped vibration plate; an edge damper portion disposed on the outer peripheral edge portion of the vibration plate; and an elliptical-shaped or a round-edged rectangular-shaped air core voice coil, wherein there is interposed a recessed portion having an elliptical-shaped or a round-edged rectangular-shaped caliber between the vibration plate and edge damper portion, and the air core voice coil is fitted into the interior of the recessed portion in such a manner that the major-axis and minor-axis directions of the air core voice coil are coincident with the major-axis and minor-axis directions of the vibration plate. In this structure, since the air core voice coil is fitted into the recessed portion, not only the deformation of the air core voice coil can be prevented but also the center position and direction of the air core voice coil can be corrected to its normal position and direction easily without using a specially designed jig. Also, even in case where some vibrations are applied to the speaker apparatus, there can be prevented the mutual poor contact of the composing parts thereof.

And, according to the invention, there is disposed a frame on which the edge damper portion is mounted for supporting the vibration plate, there is disposed a rising portion in an edge damper frame arranged on the outer periphery of the edge damper portion, the rising portion is contacted with a vertical wall portion formed on the outer peripheral edge portion of the frame, and the support portion of the edge damper frame is placed on a stepped portion formed in the frame. In this configuration, the center positions and directions of the magnetic gap, air core voice coil and vibration plate can be matched to each other more easily.

Also, according to the invention, since the rising portion is formed over the entire periphery of the edge damper frame, the center positions and directions of the magnetic gap, air core voice coil and vibration plate can be matched to each other still more easily.

And, according to the invention, the rising portion is formed only in such peripheral portion of the edge damper frame that is opposed to the major-axis direction of the edge damper frame and has a large curvature. Also, according to the invention, the rising portion is formed only in the curved portion of the round-edged rectangular shape of the edge damper frame.

This structure makes it possible to reduce the thickness of such portion of the frame that is opposed to the portion of the edge damper portion where the rising portion is not disposed. In this configuration, not only the center positions and directions of the magnetic gap, air core voice coil and vibration plate can be matched to each other accurately but also the weight of the frame can be reduced.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A speaker apparatus, comprising:

a vibration plate having an elliptical shape or a round-edged rectangular shape;

an edge damper portion disposed on an outer peripheral edge portion of said vibration plate;

an air core voice coil having an elliptical shape;

a recessed portion formed between said vibration plate and said edge damper portion, and contains said air core voice coil in such a manner that the major-axis and minor-axis directions of said air core voice coil corresponds to the major-axis and minor-axis directions of said vibration plate;

a frame for mounting said edge damper portion to support said vibration plate, having a stepped portion and a vertical wall portion; and an edge damper frame arranged on an outer periphery of said edge damper portion, having a support portion placed on the stepped portion and a rising portion being in contact with the vertical wall portion.

2. The speaker apparatus as claimed in claim 1, wherein the rising portion is formed along an entire periphery of said edge damper frame.

3. The speaker apparatus as claimed in claim 1, wherein the rising portion is formed on such peripheral portion of said edge damper frame that opposes mutually to the major-axis direction of said edge damper frame and has a large curvature.

4. The speaker apparatus as claimed in claim 1, wherein the rising portion is formed on the curved portion of the elliptical shape of said edge damper frame.

5. A speaker apparatus as claimed in claim 2, further comprising a guide portion is provided with the frame and the vibration plate, wherein the frame and a yoke include a magnetic circuit are formed by insert molding.

6. A speaker apparatus, comprising:

a vibration plate;

an edge damper portion disposed on an outer peripheral edge portion of said vibration plate;

an air core voice coil having an elliptical shape; and a recessed portion formed between said vibration plate and said edge damper portion, and contains said air core voice coil therein, a frame for mounting said edge damper portion to support said vibration plate, having a stepped portion and a vertical wall portion; and an edge damper frame arranged on an outer periphery of said edge damper portion, having a support portion place on the stepped portion and a rising portion being in contact with the vertical wall portion.

* * * * *